United States Patent [19]

Osegowitsch

[11] Patent Number: 4,556,305

[45] Date of Patent: Dec. 3, 1985

[54] ARRANGEMENT FOR AND METHOD OF REGENERATING PROCESSING BATHS FOR PHOTOSENSITIVE MATERIALS

[75] Inventor: Viktor Osegowitsch, Taufkirchen, Fed. Rep. of Germany

[73] Assignee: AGFA-Gevaert A.G., Leverkusen, Fed. Rep. of Germany

[21] Appl. No.: 424,274

[22] Filed: Sep. 27, 1982

[30] Foreign Application Priority Data

Oct. 29, 1981 [DE] Fed. Rep. of Germany ..... 3142881

[51] Int. Cl.[4] ..... G03D 13/00

[52] U.S. Cl. ..... 354/298; 354/324

[58] Field of Search ..... 354/298, 319, 320, 321, 354/322, 324

[56] References Cited

U.S. PATENT DOCUMENTS

| | | | |
|---|---|---|---|
| 3,472,143 | 10/1969 | Hixon et al. | 354/298 |
| 3,763,758 | 10/1973 | Manack et al. | 354/298 |
| 4,021,832 | 5/1977 | Krehbiel et al. | 354/298 |
| 4,057,817 | 11/1977 | Korb et al. | 354/298 |

FOREIGN PATENT DOCUMENTS

| | | |
|---|---|---|
| 1278240 | 9/1968 | Fed. Rep. of Germany . |
| 1522856 | 10/1969 | Fed. Rep. of Germany . |
| 2557253 | 2/1980 | Fed. Rep. of Germany . |

OTHER PUBLICATIONS

Research Disclosure 15551, Mar. 1977, Eastman Kodak, Williams et al.

*Primary Examiner*—A. A. Mathews

*Attorney, Agent, or Firm*—Peter K. Kontler

[57] ABSTRACT

An apparatus for developing photosensitive material has a processing bath, and transporting devices for advancing several strips and/or sheets of photosensitive material through the bath side-by-side. The strips and sheets have various widths. A sensing system is provided to sense the surface area of the material advanced through the bath. The sensing system includes a plurality of spaced sensors arranged in a row which traverses the path of the material. The sensors are designed to sense the widths of the strips and/or sheets, and adjacent ones of the sensors are spaced from one another by a distance smaller than the magnitude of the smallest difference between the widths of the strips and/or sheets. The lengths of the strips and/or sheets are taken into account by a length measuring unit which determines the frequency with which the sensors scan the strips and/or sheets. When a predetermined total surface area is reached, a signal is sent to a control unit which opens a valve for a vessel containing a regenerating solution for the bath. A predetermined quantity of the regenerating solution then enters the bath.

32 Claims, 2 Drawing Figures

ARRANGEMENT FOR AND METHOD OF REGENERATING PROCESSING BATHS FOR PHOTOSENSITIVE MATERIALS

BACKGROUND OF THE INVENTION

The invention relates generally to an arrangement for and a method of processing articles, especially an arrangement for and a method of continuously developing strips and/or sheets of photosensitive material.

More particularly, the invention relates to an arrangement for and a method of regenerating a processing bath, e.g. a developing and/or fixing bath for photosensitive materials.

A known photographic developing apparatus permits continuous development of strips and/or sheets of photosensitive material to be achieved. The photosensitive material, which may vary in width and/or quantity, is passed through the apparatus by means of conveying elements.

The apparatus is provided with means for supplying a regenerating solution to each of the different baths. An arrangement for determining the amount of regenerating solution to be added to each bath includes a device for measuring the speed of the photosensitive material as well as a device for totalling the widths of the photosensitive strips and/or sheets passing through the apparatus. The latter device composes a row of sensing elements extending transversely of the direction of movement of the photosensitive material. The two devices emit signals which are combined in a control mechanism for regulating the additions of the regenerating solutions to the different baths.

The German Offenlegungsschrift No. 1 522 856 describes various methods for sensing the width of the photosensitive material.

A regenerating arrangement having a mechanism for sensing the width and length of the photosensitive material is disclosed in the German Auslegeschrift No. 1 278 240.

In addition, a regenerating arrangement of the type outlined above is known from German Pat. No. 25 57 253. The speed of the photosensitive material is sensed by a memory or storage device which is movable towards and away from the photosensitive material, and the length of the photosensitive material is calculated from the speed. A reflex light barrier is transported transverse to the direction of movement of the photosensitive material and detects the presence of photosensitive material. When the signals representing the length and width of the photosensitive material coincide, an impulse is generated and causes a dose of the respective regenerating solutions to be supplied to the corresponding baths.

The arrangement disclosed in the German Pat. No. 25 57 253 is relatively imprecise. Furthermore, the speed of the movable light barrier cannot be arbitrarily adjusted in order to improve the scanning results. Small differences in size are detected only after a certain time interval during which improper doses of the respective regenerating solutions may have been supplied to the corresponding baths.

OBJECTS AND SUMMARY OF THE INVENTION

It is an object of the invention to provide a regenerating arrangement which makes it possible to determine the surface area of material to be treated with greater accuracy than heretofore.

Another object of the invention is to provide a regenerating arrangement which is simple and reliable.

An additional object of the invention is to improve a regenerating arrangement of the type outlined above so that the surface area of material to be processed may be determined with the greatest possible precision.

It is also an object of the invention to provide a regenerating method which enables the surface area of material undergoing processing to be determined with greater accuracy than previously.

A concomitant object of the invention is to provide a method which makes it possible to regenerate a processing bath economically and reliably.

The preceding objects, as well as others which will become apparent as the description proceeds, are achieved by the invention.

One aspect of the invention resides in a processing arrangement which includes a container accommodating a processing bath and conveying means for conveying articles of different sizes through the bath. Sensing means is provided for sensing the sizes of the articles. The sensing means comprises a series of sensing devices spaced along a predetermined direction so as to traverse a selected dimension of an article conveyed through the bath (the selected dimension may conveniently be the width of the article and the following description will be with reference to the width for the sake of simplicity). The sensing devices are operative to emit signals indicative of the presence of an article and the sensing devices are arranged such that the number of sensing devices which sense the presence of an article is representative of the width of the article. The spacing between adjacent ones of the sensing devices is smaller than the magnitude of the smallest difference between the widths of articles having different sizes. Regenerating means introduces a regenerating agent into the bath in response to the signals emitted by the sensing devices.

The sensing devices may be arranged in a row and are preferably equally spaced.

According to one embodiment of the invention, the arrangement includes activating means which is operative to activate the sensing devices sequentially.

The arrangement may be designed to process several articles simultaneously. The sensing devices are then arranged in such a manner that, for each article, the number of sensing devices representing the width of the same is obtained as a discrete value.

A memory or storage device may be incorporated in the arrangement and provide a relationship between the width of an article and the number of sensing devices which sense the presence of the article.

The arrangement may also have a device for measuring the speed of movement of the articles through the processing bath. In addition, an adding or summing device may be connected to the storage device for totalling the widths of the articles conveyed through the bath. The speed measuring device and summing device may be arranged to transmit signals to a control device which regulates the quantity of the regenerating agent added to the bath in dependence upon such signals.

The invention makes it possible to obtain precise measurements of surface area at very high scanning speeds. Furthermore, when working with articles such as strips and/or sheets of photosensitive material which are precisely cut to standard widths, only a relatively small number of sensing devices is required for width determination. Integral or continuous measurements as in certain prior art arrangements cannot consistently identify a specific size.

The arrangement in accordance with the invention also makes it possible to sense the distribution of the articles passing through the processing bath.

Another aspect of the invention resides in a processing method which involves conveying articles of different sizes through a processing bath. The width of each article is sensed by directing sensing signals toward the articles at locations along the respective widths which are spaced from one another by a distance smaller than the magnitude of the smallest difference between the various widths. The signals which impinge upon the articles are counted to thereby derive the widths of the articles and a regenerating agent is added to the processing bath in dependence upon the counting operation.

The novel features which are considered as characteristic of the invention are set forth in particular in the appended claims. The improved processing arrangement itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 2 schematically illustrates the sensing of the widths of articles having different sizes.

DESCRIPTION OF THE PREFERRED EMBODIMENTS

By way of illustration, the following description will be with reference to an apparatus for the continuous development of strips and/or sheets of photographic or photosensitive material. Such an apparatus may contain a developing bath as well as a fixing bath for the photosensitive material.

Figure 1:
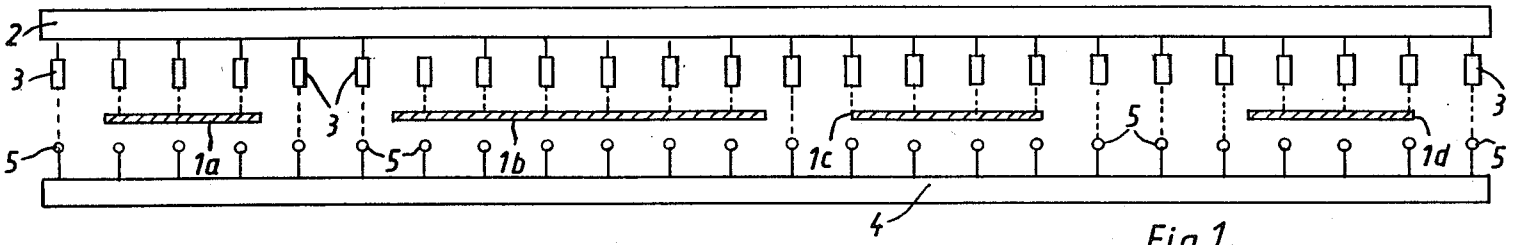
FIG. 1 is an end view of a processing arrangement according to the invention.

FIG. 1 illustrates the inlet region of the apparatus which is designed to process several photosensitive articles 1*a*–1*d* simultaneously, that is, which is designed to permit the photosensitive articles 1*a*–1*d* to pass therethrough side-by-side. The photosensitive articles 1*a*–1*d* have various widths and the quantities of the photosensitive articles 1*a*–1*d* passed through the apparatus may likewise vary.

In the illustrated embodiment, the photosensitive articles 1*a*–1*d* travel along a horizontal path which extends normal to the plane of FIG. 1. Thus, the length dimensions of the photosensitive articles 1*a*–1*d* are perpendicular to the plane of FIG. 1 while the width dimensions of the photosensitive articles 1*a*–1*d* are parallel to the plane of FIG. 1.

A support 2 is located at one side of the path of the photosensitive articles 1*a*–1*d*. The support 2 carries a series of light-emitting diodes 3 which are arranged in a row extending in the direction of the width dimensions of the photosensitive articles 1*a*–1*d*. The light-emitting diodes 3 are spaced from one another and the row defined by the same traverses the path of the photosensitive articles 1*a*–1*d*. The spacing between neighboring light-emitting diodes 3 is preferably uniform.

A support 4 is arranged on the side of the path opposite the support 2. The support 4 is parallel to the support 2 and carries a series of photocells 5 equal in number to the light-emitting diodes 3. Each of the photocells 5 is aligned with one of the light-emitting diodes 3.

Each light-emitting diode 3 and its corresponding photocell 5 together constitute a sensing device.

FIG. 2 illustrates how the minimum number of sensing devices required to positively identify articles of different sizes may be derived. To this end, FIG. 2 shows a series of sensing devices 101–126 arranged alongside a set of articles I–IV having different widths. It is assumed that the left-hand end of each of the articles I–IV just covers the sensing device 101 so that counting may be begun from the latter.

A problem involved in establishing the spacing between adjacent ones of the sensing devices 101–126 resides in using the smallest possible number of sensing devices 101–126 so as to minimize costs while nevertheless permitting the widths of the articles I–IV to be determined unambiguously. It must be further considered that the articles I–IV do not move along straight paths but may shift laterally through distances exceeding ten millimeters.

It will be understood that, if the sensing devices 101–126 are constituted by pairs of light-emitting diodes and photocells as in FIG. 1, the sensing devices 101–126 must be designed and arranged such that signals of adequate strength are obtained between the light-emitting diodes and the corresponding photocells.

Investigations have shown that a square of approximately 0.5 millimeter on a side constitutes a necessary and sufficient area for optoelectronic components such as light-emitting diodes and photocells. In other words, the signal emitted by a light-emitting diode diverges as the signal travels towards the corresponding photocell. Satisfactory operation is achieved when the light-emitting diode and the photocell are located at such a distance from one another that the signal is approximately 0.5 millimeter wide upon reaching the photocell. The sensing devices 101–126 in the form of optoelectronic components, it has been found that the widths of the articles I–IV can be positively determined when adjacent ones of the sensing devices 101–126 are spaced by a distance equal to the smallest difference between the widths of the articles I–IV minus twice the width of the signal at the photocell.

In the illustration of FIG. 2, the smallest difference between the widths of the articles I–IV is assumed to be 6.35 millimeters. As mentioned previously, satisfactory operation of a sensing device constituted by a light-emitting diode and a photocell is achieved when the light-emitting diode and the photocell are so situated relative to one another that the signal from the light-emitting diode has a width of approximately 0.5 millimeter at the photocell. Thus, for sensing devices 101–126 in the form of light-emitting diodes and photocells, the spacing between adjacent ones of the sensing devices 101–126 would be 6.35 millimeters minus $2\times0.5$ millimeter which is equal to 5.35 millimeters.

Article I in FIG. 2 is assumed to have a width of about 101.6 millimeters. When adjacent ones of the sensing devices 101–126 are spaced by 5.35 millimeters as calculated above, article I traverses 18 of the sensing devices 101–126 in the illustrated position. The left-hand edge of article I coincides with the sensing device 101 while the right-hand edge of article I is located between the sensing devices 118 and 119. If article I shifts to the right, the right-hand edge thereof will come into coincidence with the sensing device 119 only after the left-hand edge no longer coincides with the sensing device 101 so that article I again traverses 18 of the sensing devices 101–126. However, when article I shifts towards the sensing device 119, there will be a short period during which the left-hand edge thereof will be clear of the sensing device 101 while the right-hand edge is still clear of the sensing device 119. Accordingly, for a short time, article I will traverse only 17 of the sensing devices 101–126. Similarly, if article I shifts to the left, the sensing device immediately to the left of the sensing device 101 will come into coincidence with article I only after the latter as cleared the sensing device 118 so that the article I traverses no more than 18 sensing devices. Again, there will be a period between the time that the article I clears the sensing device 118 and the time that the article I comes into coincidence with the sensing device immediately to the left of the sensing device 101 during which the article I traverses only 17 sensing devices.

The same applies to the article II which, in the illustrated position, traverses 20 of the sensing devices 101–126. If the article II shifts to the left or the right, there will be a short period during which it will traverse only 19 sensing devices. However, it is not possible for the article II to traverse more than 20 sensing devices.

In a similar fashion, the article III can traverse 21 or 22 sensing devices while the article IV can traverse 25 or 26 sensing devices.

The preceding explanation illustrates that, by selecting the spacing of the sensing devices 101–126 as a function of the smallest difference between the widths of the articles I–IV, each width is characterized by a set of two numbers. These numbers represent the sensing devices traversed by the corresponding one of the articles I–IV. The particular number of a set which applies depends on the position of the respective article I–IV. The sets of numbers corresponding to different widths do not overlap.

Figure 3:
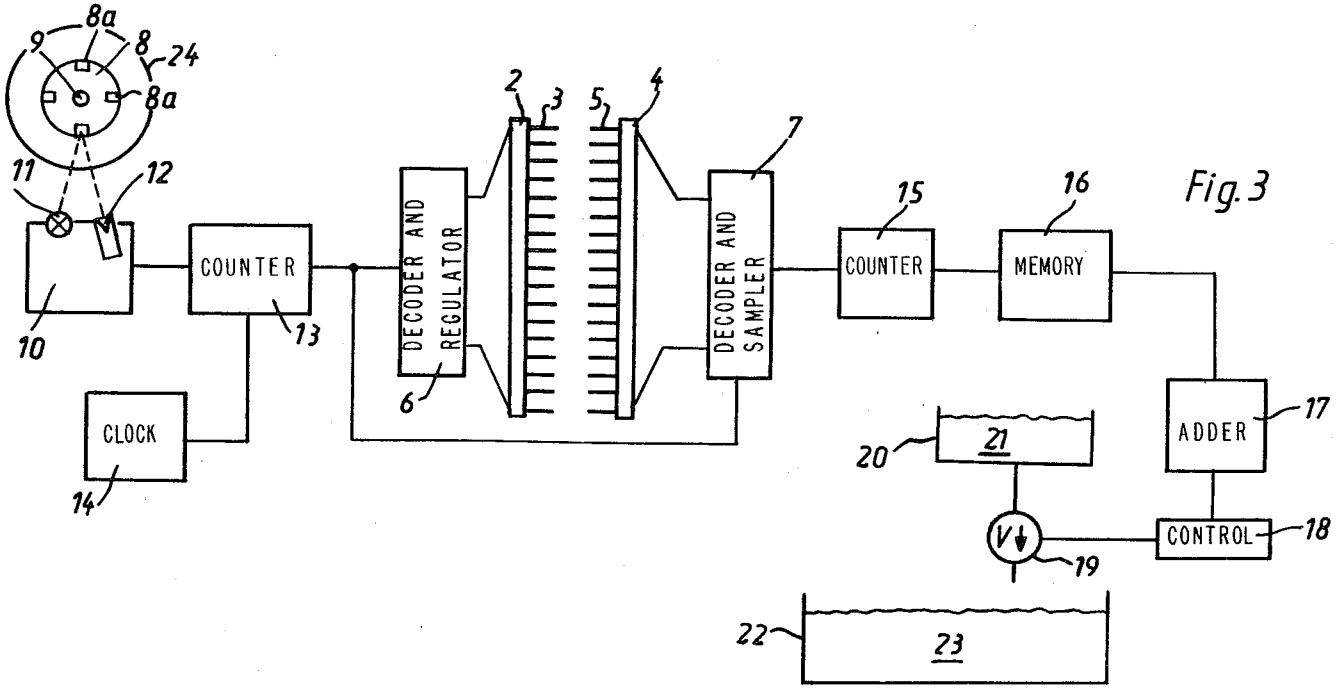
FIG. 3 is a block diagram of a circuit for regulating the addition of a regenerating agent to a processing bath.

FIG. 3 is a block diagram of a circuit for activating the sensing devices 3, 5 of FIG. 1. As shown in FIG. 3, the support 2 which carries the light-emitting diodes 3 is connected with a decoding and regulating unit 6 while the support 4 which carries the photocells 5 is connected with a decoding and sampling unit 7.

FIG. 3 further illustrates a drive shaft 9 constituting part of the drive system for conveying the photosensitive articles 1*a*–1*d* through the developing apparatus. One or more conveying rollers 24 are mounted on the drive shaft 9 and are arranged to engage the photosensitive articles 1*a*–1*d*. The drive shaft 9 also carries a disc 8 which is provided with a plurality of circumferentially spaced projections, slots or other types of marks 8*a*. The disc 8 is mounted for rotation with the drive shaft 9. The disc 8 forms part of a unit for measuring the speeds and the lengths of the photosensitive articles 1*a*–1*d*. In addition to the disc 8, the speed measuring unit has a device 10 which includes a reflex light barrier comprising a light source 11 and a light sensor 12.

The device 10 has an output which is connected to one input of a counter 13. The counter 13 has a second input which is connected to a clocking unit or pulse generator 14. The counter 13 is set in such a manner that, each time the counter 13 is activated, it counts to a number equalling the number of sensing devices 3,5.

The output of the counter 13 is connected with the decoding and regulating unit 6 as well as the decoding and sampling unit 7.

The decoding and sampling unit 7 communicates with a second counter 15 which is capable of being reset. The counter 15, in turn, has an output which is connected to the input of a memory or storage unit 16. The storage unit 16 contains a relationship between the width of an article and the number of sensing devices 3,5 traversed by such article.

The storage unit 16 communicates with a summing or adding unit 17. The latter, in turn, has an output which is connected to the input of a control unit 18. The control unit 18 regulates a valve 19 for a container 20 which accommodates a bath 21 of a regenerating solution. The valve 19 controls the admission of the regenerating solution into the processing bath 23, i.e. a developing or fixing bath, contained in a vessel 22. The control unit 18 calculates the length of time for which the valve 19 must be open, and opens and closes the valve 19 accordingly.

The operation of the arrangement illustrated in FIG. 3 is as follows:

The drive shaft 9 is rotated in order to advance the photosensitive articles 1*a*–1*d* through the developing apparatus. The disc 8 rotates with the drive shaft 9 and the marks 8*a* are sensed by the light barrier 11,12. The rotational speed of the disc 8 is representative of the speed of the photosensitive articles 1*a*–1*d* and the spacing between the marks 8*a* is indicative of the lengths of the photosensitive articles 1*a*–1*d*.

When the light barrier 11,12 detects the presence of a mark 8*a*, the device 10 delivers a signal to the counter 13. This signal activates the counter 13 which begins counting at a speed determined by the pulse generator 14. As mentioned previously, the counter 13 is set to count to a number equalling the number of sensing devices 3,5. The number of sensing devices 3,5 may, for example, be 150. At each count of the counter 13, one of the light-emitting diodes 3 is activated for a short period via the decoding and regulating unit 6 while the corresponding photocell 5 is simultaneously sampled via the decoding and sampling unit 7. The activation of the light-emitting diodes 3 thus occurs sequentially as does the sampling of the photocells 5. Moreover, the photocells 5 are sampled in the same order as the light-emitting diodes 3 are activated.

A series of pulses equal in number to the number of sensing devices 3,5 is delivered to the counter 15 by the decoding and sampling unit 7. Certain of the pulses have larger amplitudes than others. The pulses with the smaller amplitudes correspond to sensing devices 3,5 which are traversed by the photosensitive articles 1*a*–1*d* while the pulses with the larger amplitudes correspond to sensing devices 3,5 which are not traversed by the photosensitive articles 1*a*–1*d*.

The pulses are processed in a manner which is not described in detail since it forms no part of the invention. Subsequent to processing, the pulses with the smaller magnitudes are counted by the counter 15. Whenever a pulse with a larger magnitude enters the counter 15, the latter is reset to zero and does not begin to count again until a pulse of smaller amplitude arrives.

The numbers from the counter 15 are fed to the storage unit 16. The latter converts the numbers into widths which are transmitted to the summing unit 17 where they are totalled. The summing unit 17 sends a signal representative of the sum of the widths to the control unit 18. The control unit 18 determines the time for which the valve 19 must be opened and operates the valve 19 accordingly so that a predetermined amount of the regenerating solution from the bath 21 flows into the processing bath 23.

The lengths of the photosensitive articles 1*a*–1*d* are included in the calculations for determining the time for which the valve 19 must be open by virtue of the fact that the frequency at which the widths of the photosensitive articles 1*a*–1*d* are measured depends upon the speed at which the photosensitive articles 1*a*–1*d* are advanced. In other words, as the speed of advance increases, the rotational speed of the disc 8 increases so that the marks 8*a* are detected more frequently and the widths of the photosensitive articles 1*a*–1*d* are sampled more frequently. The reverse is true when the speed of advance decreases.

It is not necessary to specifically determine the widths of the photosensitive articles 1*a*–1*d* as is done in the arrangement of FIG. 3. Instead, the arrangement may be simplified by adding the pulses of smaller magnitude which are emitted by the decoding and sampling unit 7. Thus, a given number of such pulses represents a specific surface area which is different for different sampling rates. The pulses may be added until the equivalent of a predetermined surface area is achieved at which time a corresponding quantity of the regenerating solution from the bath 21 is supplied to the processing bath 23.

The decoding and regulating unit 6, the decoding and sampling unit 7, the device 10, the light barrier 11,12, the counters 13 and 15, the pulse generator 14, the storage unit 16, the summing unit 17 and the control unit 18 are all conventional and form no part of the invention per se.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. An arrangement for continuously developing sheet-like photosensitive articles having different widths, said arrangement comprising:

(a) a container for accommodating a processing bath;

(b) conveying means for conveying said articles through said container in a predetermined direction transverse to said widths;

(c) sensing means for sensing the sizes of articles conveyed through said container, said sensing means including a measuring device for determining the speed of advance of said articles through said container, and said sensing means further including a series of substantially uniformly spaced sensing devices disposed in a row which extends transversely of said predetermined direction, said sensing devices being arranged such that the spacing between adjacent ones of said sensing devices is smaller than the magnitude of the smallest difference between said widths and such that the number of sensing devices which sense the presence of an article is representative of a single one of said widths;

(d) activating means for activating said sensing devices sequentially;

(e) storage means connected with said sensing means and relating said widths to the number of sensing devices which sense the presence of an article;

(f) summing means connected with said storage means and operative to total the widths of articles conveyed through said container;

(g) regenerating means for introducing a regenerating agent into said container; and (h) control means for regulating said regenerating means in response to signals received from said measuring device and said summing means.

2. An arrangement for processing photosensitive articles having different widths, said arrangement comprising:

(a) a container accommodating a processing bath;

(b) conveying means for conveying said articles through said bath in a predetermined direction transverse to said widths, said conveying means including a drive shaft;

(c) sensing means for sensing the sizes of articles conveyed through said bath, said sensing means including a series of sensing devices spaced transversely of said predetermined direction so as to traverse said widths, and said sensing devices being operative to emit sensing signals indicative of the presence of an article, said sensing devices being arranged such that the number of sensing devices which sense the presence of an article is representative of the respective width, and the spacing between adjacent ones of said sensing devices being smaller than the magnitude of the smallest difference between said widths, said sensing means further including a measuring device for determining the speed of movement of said articles through said bath, and said measuring device being operative to emit measuring signals indicative of the speed of said articles, said measuring device comprising a signal emitting element having a light source, a measuring element mounted for movement with said drive shaft and having spaces, light reflective portions for reflecting light from said light source, and a receiving element responsive to light reflected from said portions;

(d) regenerating means for introducing a regenerating agent into said bath; and (e) control means for regulating said regenerating means in response to a combination of said sensing and measuring signals.

3. An arrangement for processing photosensitive articles having different widths, said arrangement comprising:

(a) a container for accommodating a processing bath;

(b) conveying means for conveying said articles through said container in a predetermined direction transverse to said widths;

(c) sensing means for sensing the sizes of articles conveyed through said container, said sensing means including a series of sensing devices spaced transversely of said predetermined direction, and said sensing devices being operative to emit sensing signals indicative of the presence of an article, said sensing devices being arranged such that the spacing between adjacent ones of said sensing devices is smaller than the magnitude of the smallest difference between said widths and such that the number of sensing devices which sense the presence of an article is representative of a single one of said widths;

(d) storage means relating said widths to the number of sensing devices which sense the presence of an article; and (e) regenerating means for introducing a regenerating agent into said container in response to said sensing signals, said storage means being connected between said sensing means and said regenerating means.

4. An arrangement as defined in claim 3, comprising a counter between said sensing means and said storage means for counting the sensing signals corresponding to an article.

5. An arrangement for processing photosensitive articles having different widths each of which constitutes one of a predetermined set of widths, said arrangement comprising:

(a) a container for accommodating a processing bath;

(b) conveying means for conveying said articles through said container in a predetermined direction transverse to their widths;

(c) sensing means for sening the sizes of articles conveyed through said container, said sensing means including a series of sensing devices spaced transversely of said predetermined direction, and said sensing devices being operative to emit sensing signals indicative of the presence of an article, said sensing devices being arranged such that the spacing between adjacent ones of said sensing devices is smaller than the magnitude of the smallest difference between said widths and such that the number of sensing devices which sense the presence of an article is representative of a single one of said widths;

(d) storage means connected with said sensing means and relating said widths to the number of sensing devices which sense the presence of an article; and (e) regenerating means for introducing a regenerating agent into said container in response to said sensing signals and as a function of the widths derived from said storage means.

6. An arrangement as defined in claim 5, wherein said sensing devices are substantially equally spaced.

7. An arrangement as defined in claim 5, comprising activating means for activating said sensing devices sequentially.

8. An arrangement as defined in claim 5, wherein said sensing devices are arranged to sense the presence of a plurality of articles simultaneously and to provide a discrete indication of the width of each article.

9. An arrangement as defined in claim 5, wherein said sensing means comprises a measuring device for determining the speed of movement of said articles through said container, said measuring device being operative to emit measuring signals indicative of the speed of said articles; and further comprising control means for regulating said regenerating means in response to a combination of said sensing and measuring signals.

10. An arrangement as defined in claim 9, said conveying means comprising a drive shaft; and wherein said measuring device comprises a signal emitting element, and a measuring element mounted for movement with said drive shaft and having spaced portions for detection by signals emitted by said signal emitting element.

11. An arrangement as defined in claim 10, wherein said drive shaft is rotatable and said measuring element comprises a disc mounted for rotation with said drive shaft.

12. An arrangement as defined in claim 9, said sensing means comprising a predetermined number of said sensing devices; and further comprising a counter for sequentially activating said sensing devices by counting to said predetermined number.

13. An arrangement as defined in claim 9, wherein said measuring device is operative to periodically activate said counter.

14. An arrangement as defined in claim 12, comprising a pulse generator for regulating the counting speed of said counter.

15. An arrangement as defined in claim 12, each of said sensing devices comprising a signal emitter located on one side of the path of travel of said articles and a receiver responsive to signals from the emitter located on the opposite side of such path; and wherein said counter is connected to said emitters and said receivers and is operative to sequentially activate said emitters and said receivers in the same order.

16. An arrangement as defined in claim 5, wherein said conveying means is arranged to convey articles in the form of strips and sheets.

17. An arrangement as defined in claim 5, comprising summing means for totalling the widths of different articles conveyed through said container, said summing means being operative to regulate said regenerating means in dependence upon the sums of said width.

18. An arrangement as defined in claim 5, wherein said sensing devices are arranged in a row.

19. An arrangement as defined in claim 5, wherein each of said sensing devices comprises a signal emitter located on one side of the path of travel of said articles and a receiver responsive to signals from the emitter located on the opposite side of such path.

20. An arrangement as defined in claim 19, wherein said emitters comprise light-emitting diodes and said receivers comprise photocells.

21. An arrangement as defined in claim 19, comprising a pair of substantially parallel, elongated supports extending transversely of said predetermined direction and located on opposite sides of the path of travel of said articles, said emitters being mounted on one of said supports and said receivers being mounted on the other of said supports.

22. An arrangement as defined in claim 19, wherein the signals transmitted by said emitters diverge and span a predetermined distance at the corresponding receivers, said spacing being substantially equal to said difference minus twice said predetermined distance.

23. An arrangement as defined in claim 5, comprising control means for calculating the quantity of regenerating agent to be introduced into said container, said control means being connected between said sensing means and said regenerating means.

24. An arrangement as defined in claim 23, wherein said regenerating means comprises a valve which is regulated by said control means.

25. A method of processing photosensitive articles having different widths each of which constitutes one of a predetermined set of widths, said method comprising the steps of:

(a) conveying said articles through a processing bath in a predetermined direction transverse to their widths;

(b) sensing said widths by directing sensing signals towards said articles at a series of locations arranged such that the spacing between adjacent ones of said locations is smaller than the magnitude of the smallest difference between said widths and such that the number of signals impinging upon an article is representative of a single one of said widths;

(c) storing a relationship between said widths and the number of signals which impinge upon an article;

(d) counting the signals which impinge upon said articles;

(e) deriving a width for each article from said relationship; and (f) adding a regenerating agent to said bath in dependence upon the counting step and as a function of the widths obtained from the deriving step.

26. A method as defined in claim 25, wherein said sensing signals are directed toward said articles sequentially.

27. A method as defined in claim 25, wherein the signals which impinge upon said articles are counted sequentially.

28. A method as defined in claim 25, comprising the steps of measuring the speed of advance of said articles, and combining the results of the counting and measuring steps, the adding step being performed in dependence upon the results of the combining step.

29. A method as defined in claim 25, comprising the step of summing said widths.

30. A method as defined in claim 25, wherein said locations are substantially equally spaced.

31. A method as defined in claim 25, wherein said sensing signals are emitted at first positions and detected at second positions spaced from said first positions, said sensing signals diverging from said first positions and spanning a predetermined distance at said second positions, and said spacing being substantially equal to said difference minus twice said predetermined distance.

32. A method as defined in claim 25, wherein said locations are arranged in a row.

* * * * *